US007622052B1

(12) United States Patent
Quarantello et al.

(10) Patent No.: US 7,622,052 B1
(45) Date of Patent: Nov. 24, 2009

(54) METHODS FOR CHEMICAL MECHANICAL PLANARIZATION AND FOR DETECTING ENDPOINT OF A CMP OPERATION

(75) Inventors: Justin Quarantello, Higley, AZ (US); Thomas Laursen, New Haven, CT (US); Karl Kasprzyk, Gilbert, AZ (US); Rob Stoya, Cave Creek, AZ (US)

(73) Assignee: Novellus Systems, Inc., San Jose, CA (US)

( * ) Notice: Subject to any disclaimer, the term of this patent is extended or adjusted under 35 U.S.C. 154(b) by 505 days.

(21) Appl. No.: 11/473,944

(22) Filed: Jun. 23, 2006
(Under 37 CFR 1.47)

(51) Int. Cl.
*H01L 21/302* (2006.01)

(52) U.S. Cl. ..... 216/86; 216/88; 438/10; 438/17; 438/692

(58) Field of Classification Search ..... 216/86
See application file for complete search history.

(56) References Cited

U.S. PATENT DOCUMENTS 5,659,492 A * 8/1997 Li et al. ..... 700/266
5,777,739 A * 7/1998 Sandhu et al. ..... 356/503
6,004,187 A * 12/1999 Nyui et al. ..... 451/5
6,276,987 B1 * 8/2001 Li et al. ..... 451/5
6,402,589 B1 * 6/2002 Inaba et al. ..... 451/5
6,953,382 B1 * 10/2005 Korovin et al. ..... 451/5
7,086,927 B2 * 8/2006 Moore et al. ..... 451/5
7,115,017 B1 * 10/2006 Laursen et al. ..... 451/5
7,160,739 B2 * 1/2007 Shanmugasundram et al. ..... 438/14
7,189,140 B1 * 3/2007 Shugrue et al. ..... 451/5
7,264,537 B1 * 9/2007 Laursen et al. ..... 451/8
2006/0286904 A1 * 12/2006 Swedek et al. ..... 451/5
2008/0071414 A1 * 3/2008 Fujita et al. ..... 700/121

* cited by examiner

*Primary Examiner*—Anita K Alanko
(74) *Attorney, Agent, or Firm*—Ingrassia Fisher & Lorenz, P.C.

(57) ABSTRACT

Methods are provided for chemical mechanical planarization of a layer and for determining the endpoint of a CMP operation. In accordance with one embodiment the method for determining an endpoint comprises making a plurality of eddy current thickness measurement of the layer being planarized, each of the plurality of measurements spaced apart by a predetermined length of time. A difference is calculated between sequential ones of the plurality of eddy current measurements, and a predetermined minimum threshold for the difference is set. The endpoint is defined as a calculated difference less than the predetermined minimum threshold.

10 Claims, 3 Drawing Sheets

METHODS FOR CHEMICAL MECHANICAL PLANARIZATION AND FOR DETECTING ENDPOINT OF A CMP OPERATION

TECHNICAL FIELD

The present invention generally relates to chemical mechanical planarization, and more particularly relates to methods for chemical mechanical planarization and to detecting the endpoint of a chemical mechanical planarization operation.

BACKGROUND

The manufacture of many types of work pieces requires the substantial planarization of at least one surface of the work piece. Examples of such work pieces that require a planar surface include semiconductor wafers, optical blanks, memory disks, and the like. One commonly used technique for planarizing the surface of a work piece is the chemical mechanical planarization (CMP) process, a process commonly practiced in a multi-zonal processing apparatus. In the CMP process a work piece, held by a work piece carrier head, is pressed against a polishing pad and relative motion is initiated between the work piece and the polishing pad in the presence of a polishing slurry. The mechanical abrasion of the surface combined with the chemical interaction of the slurry with the material on the work piece surface ideally produces a surface of a desired shape, usually a planar surface. The terms "planarization" and "polishing," or other forms of these words, although having different connotations, are often used interchangeably by those of skill in the art with the intended meaning conveyed by the context in which the term is used. For ease of description such common usage will be followed and the term "chemical mechanical planarization" will generally be used herein with that term and "CMP" conveying either "chemical mechanical planarization" or "chemical mechanical polishing." The words "planarize" and "polish" will also be used interchangeably.

The construction of the carrier head of a CMP apparatus and the relative motion between the polishing pad and the carrier head as well as other process variables have been extensively engineered in an attempt to achieve a desired rate of removal of material across the surface of the work piece and hence to achieve the desired final surface shape. For example, the carrier head generally includes a flexible membrane that contacts the back or unpolished surface of the work piece and accommodates variations in that surface. A number of pressure chambers are provided behind the membrane so that different pressures can be applied to various zones on the back surface of the work piece to cause desired variations in polishing rate across the front surface of the work piece.

End point detection probes are often used to detect the completion of a polishing operation. The completion of the polishing operation is signaled or "called", in accordance with a detection algorithm, as a function of the remaining material thickness. Upon detection of the end point signal, the CMP operation is either terminated immediately or after some prescribed delay denoted as an "over polish time." The proper identification of endpoint is an important step in a CMP operation. Consider, for example, the removal of a copper layer from the surface of a semiconductor wafer as part of the process of forming a damascene pattern of interconnect metallization on that semiconductor wafer. If the endpoint is called too soon, an undesired layer of copper will remain on the semiconductor wafer causing an electrical short between unrelated metal conductors. If the endpoint is called too late, the polishing operation may cause damage to either the interconnect metal pattern or to the underlying insulator layers.

A number of different mechanisms and methods are available and commonly used for detecting the end point of a CMP operation. Such mechanisms and methods include optical end point detectors, eddy current monitors, measuring the drag experienced by the motors generating the relative motion between the work piece and the polishing pad, and the like. Each of these end point detection mechanisms and methods suffers from technical hurdles, especially when the layer being polished or removed is very thin. Specifically, calibration of the mechanism or method can be difficult at very thin layers, and noise sources can become a significant source of variation and error from work piece to work piece.

Accordingly, it is desirable to provide a chemical mechanical planarization method including an accurately determined end point. In addition, it is desirable to provide a method for accurate end point detection of a CMP operation. Furthermore, other desirable features and characteristics of the present invention will become apparent from the subsequent detailed description and the appended claims, taken in conjunction with the accompanying drawings and the foregoing technical field and background.

BRIEF DESCRIPTION OF THE DRAWINGS

The present invention will hereinafter be described in conjunction with the following drawing figures, wherein like numerals denote like elements, and wherein FIG. 1 schematically illustrates, in cross section, a chemical mechanical planarization (CMP) apparatus with which the inventive methods can be practiced.

DETAILED DESCRIPTION

The following detailed description is merely exemplary in nature and is not intended to limit the invention or the application and uses of the invention. Furthermore, there is no intention to be bound by any expressed or implied theory presented in the preceding technical field, background, or the following detailed description.

Figure 1:
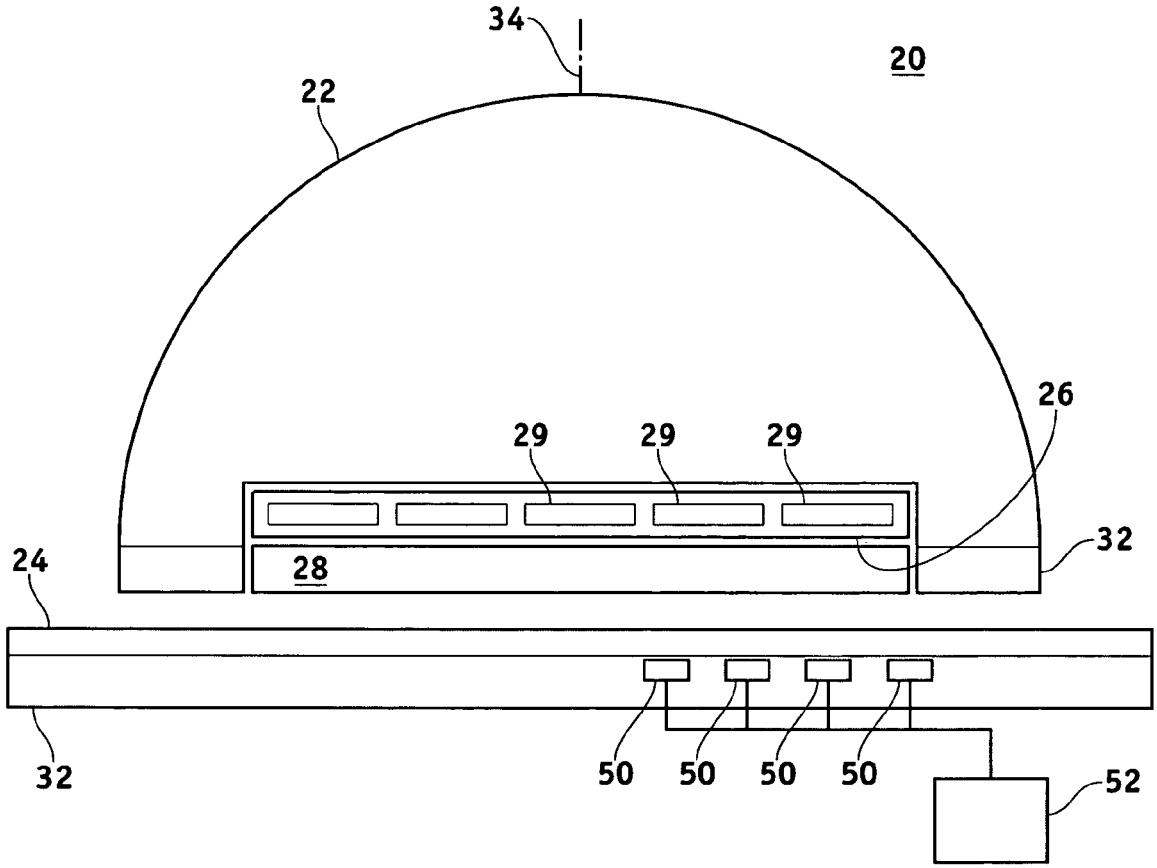

FIG. 1 schematically illustrates, in cross section, a chemical mechanical planarization (CMP) apparatus 20. Although there are many different forms of CMP apparatus, all operate on similar principles of pressing a work piece that is to be polished or planarized against a polishing pad, usually in the presence of a polishing slurry that contains chemical reactants and abrasive particles. Relative motion is established between the work piece and the polishing pad, and the surface of the work piece is removed by the combination of chemical reaction and mechanical abrasion. A CMP operation can be used to polish or planarize a variety of different work pieces. For purposes of illustration only, the work pieces will be referred to herein as semiconductor wafers because CMP operations are used extensively in the manufacture of semiconductor devices on semiconductor wafers. CMP operations are used, for example, to planarize starting wafers, to planarize insulating layers overlying a semiconductor substrate, to remove metal or other conductor layers overlying insulator layers, and to form electrically conductive interconnection patterns by a damascene process. Those of skill in the art will appreciate that CMP operations can also be used in other semiconductor processing operations and in the processing of other work pieces.

CMP apparatus 20 is illustrative of apparatus such as the Xceda CMP system that is available from Novellus Systems, Inc. of San Jose, Calif. CMP apparatus 20 includes a carrier head 22 and a polishing pad 24. Carrier head 22 includes a flexible diaphragm 26 that presses against the upper surface of a semiconductor wafer 28, the lower surface of which is to be planarized. Preferably the diaphragm includes a plurality of concentric zones 29 that can be individually pressurized to predetermined pressures to exert different appropriate pressures against various zones of the wafer. A retaining ring or wear ring 30 serves to restrict the lateral movement of the wafer and to keep the wafer centered under the carrier head. Polishing pad 24 is supported on a platen 32. Mechanisms (not illustrated) are connected to the carrier head and to the platen that enable the wafer and/or the polishing pad to be placed in motion during a CMP operation so that relative motion is established between the wafer and the polishing pad. Preferably the carrier head, and hence the wafer, is rotated about an axis 34 that is perpendicular to the surface of the wafer and to the layer that is being polished on the lower surface of the wafer. Platen 32 and polishing pad 24 can be moved in a linear, rotational, orbital, or other pattern, but preferably is moved in an orbital pattern. A polishing slurry is supplied to the polishing pad, for example through a manifold (not illustrated) within and beneath platen 32. The slurry can then be injected through an array of holes in the top of the platen and through corresponding holes in the polishing pad. The composition of the polishing slurry is determined by the composition of the material being removed from the semiconductor wafer or other work piece. For example, if the layer to be polished from the work piece is a layer of copper, the polishing slurry might include alumina as an abrasive and hydrogen peroxide.

CMP apparatus 20 also includes an end point detector system. The end point is usually defined as the completion or near completion of the removal of a layer overlying the semiconductor wafer. A number of different systems can be used to detect the end point of the CMP operation. When the layer being removed is formed of an electrically conductive material such as copper or other metal, the preferred end point detector system, in accordance with an embodiment of the invention, is an eddy current end point detection system, although other systems such as an optical detector system can by used in accordance with some embodiments of the invention. An eddy current end point detection system, which is generally located in the platen, includes an eddy current generator and an eddy current detector. The eddy current generator includes a mechanism for generating an oscillating magnetic field. The oscillating magnetic field induces eddy currents in the electrically conductive layer material overlying the semiconductor wafer. The eddy current detector includes a tuned circuit that is electrically in parallel with the impedance represented by the layer of conductive material. As the thickness of the layer of conductive material changes during the CMP operation, the impedance of that layer changes, causing a change in impedance matching of the tuned circuit. This change can be correlated to the thickness of the conductive layer. As explained above, however, the measurement of thickness of the conductive layer, and hence the end point of the CMP operation, can be inaccurate, especially for thin layers, because of problems with calibration of the system and noise. Additional inaccuracies result from the nonuniform nature of both the layer being polished and the layer underlying the layer being polished. The underlying layer, for example, may have been patterned as part of the process of manufacturing the semiconductor device or other work piece.

In accordance with one embodiment of the invention, a preferred end point detection system includes four separate eddy current end point detection systems 50, each including an eddy current generators and an associated eddy current detector, arrayed along a radius of platen 32 as illustrated in FIG. 1. The eddy current end point detection systems are each coupled to a general purpose digital computer schematically represented at 52.

Figure 2:
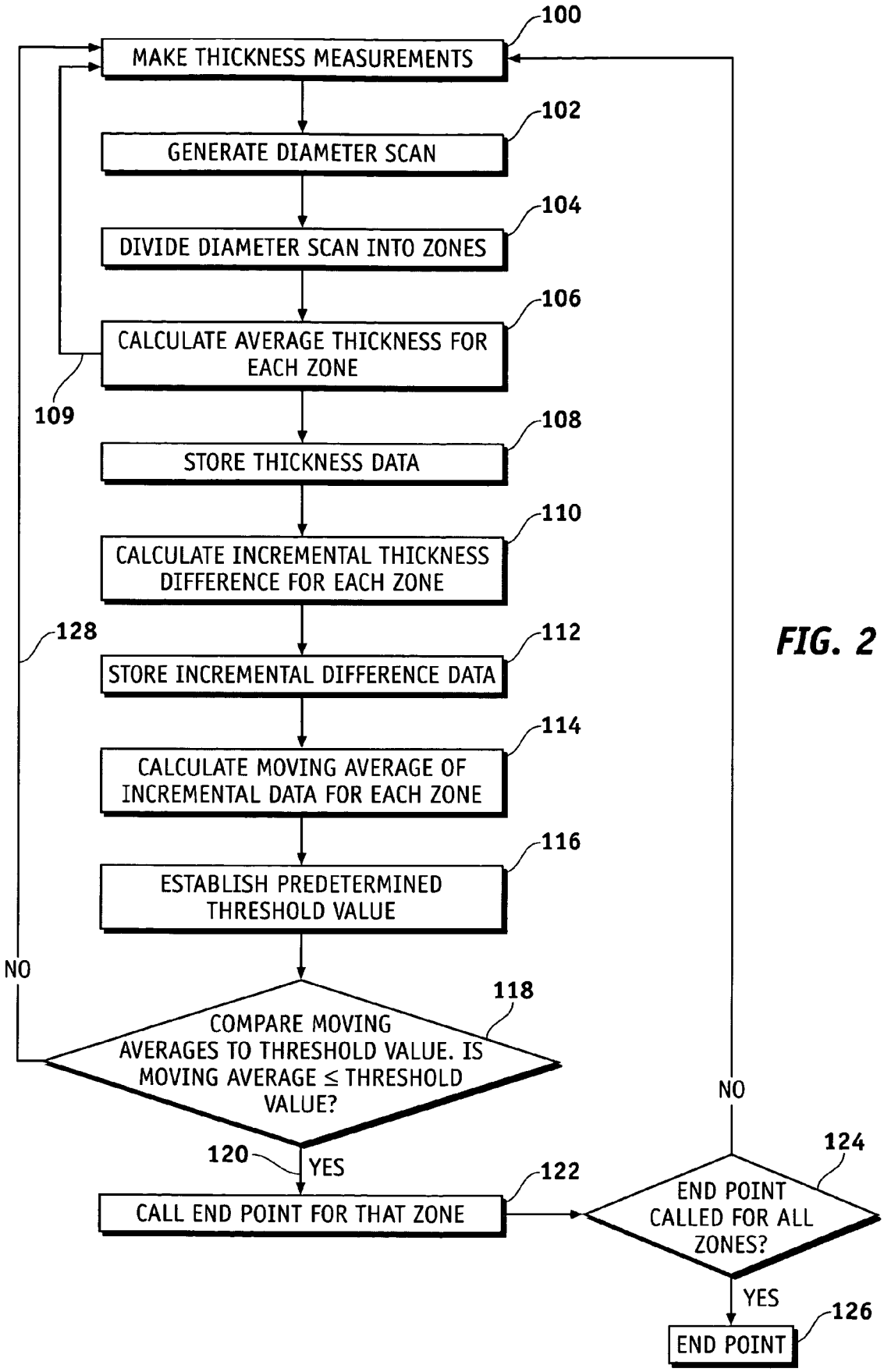
FIG. 2 illustrates in flow chart format a method in accordance with one embodiment of the invention.

A method in accordance with one embodiment of the invention is illustrated in flow chart format in FIG. 2. End point detection of a CMP operation, in accordance with this embodiment of the invention begins by making a plurality of thickness measurements of a layer being planarized as indicated at step 100. Preferably the plurality of thickness measurements are made by a plurality of eddy current end point detection systems. Also preferably, the plurality of measurements are made by each of the eddy current systems repeatedly at small predetermined increments of time. For example, measurements can be made by each of the eddy current systems about once every millisecond (e.g., a sampling rate of about 1200 Hertz). Each of the measurements is reported to a computer that calculates a layer thickness based on the measurement from the eddy current systems using conventional algorithms. The computer can also be programmed to calculate a location at which each of the measurements was made. At predetermined time intervals, such as once every second, a diameter scan is generated that is based on the thickness measurements and the location of those measurements as illustrated at step 102. A diameter scan indicates the thickness of the layer along a diameter of the wafer. A diameter scan is useful because thickness variations on a wafer, both initially and during a CMP operation, are generally concentric.

In accordance with one embodiment of the invention, the method of end point detection continues by dividing the diameter scan into a plurality of zones as indicated at step 104. The number of zones can be chosen dependent upon the initial characteristics of the work piece that is to be polished, and can vary from as little as one up to several zones. When more than one zone is used, the zones typically represent concentric rings on the surface of the wafer. As indicated at step 106, an average thickness is calculated for each of the zones, with the average thickness calculated by averaging the thickness measurements reported for that zone. At step 108 those average thickness values are stored. In a preferred embodiment the value that is calculated and stored is the average value, however any thickness based metric can be utilized. For ease of discussion, any such value will hereinafter be referred to as an average value.

While proceeding down the flow chart, the method in accordance with this embodiment of the invention includes taking continuous measurements in a loop completed by path 109. As indicated by path 109, additional thickness measurements are continuously made, additional diameter scans are generated, one for each of the predetermined intervals of time, the diameter scan is divided into zones, an average thickness is calculated for each zone, and the calculated average thickness values are stored. In step 110 a difference is calculated for each sequential pair of stored values of average thickness for each of the zones. The calculated difference can be expressed as an incremental change in thickness of the layer being polished or as an incremental removal rate of that layer where the removal rate is the change in layer thickness per unit of time for each zone. The incremental change in thickness or incremental removal rate for each zone is stored at step 112. In a preferred method the average removal rate is used, but any removal rate based metric can be used. Again, for ease of discussion, any such value will hereinafter be referred to as the average removal rate.

At step 114 a moving average of the stored incremental data is calculated for each zone. If the diameter scan is generated every second, the moving average can be, for example, a five second moving average. At step 116 a predetermined threshold value is established. The threshold value can be expressed as a minimum incremental change in measured thickness or as a minimum removal rate, depending on how the incremental data for each zone is expressed.

Although individual measurements of thickness may be subject to error, it has been found that incremental changes in thickness or incremental changes in removal rate, especially when smoothed by taking a moving average, lead to an accurate end point detection. As the end point of the CMP operation is approached, the incremental changes approach zero. In step 118 the moving averages calculated in step 114 for each of the zones are compared to the threshold value established in step 116. If the moving average for a zone is less than the established threshold, the method in accordance with one embodiment of the invention takes path 120 and "calls" an end point for that zone as indicated in step 122. That is, when the incremental changes in thickness or incremental changes in removal rate decreases below some predetermined value, the end point is called. To "call" an end point is to ascertain that a predetermined point in the process has been reached. The same comparison is made for each of the zones. If all of the zones have called an end point (step 124), the end point of the CMP operation is called as indicated at step 126. If all of the zones have not called an end point, the method returns to step 100 and continues until all of the zones do have a moving average less than the threshold and an end point is called for all zones. If the comparison made at step 118 determines that the calculated moving average is not less than the established threshold, the method takes path 128 and returns to step 100.

Figure 3:
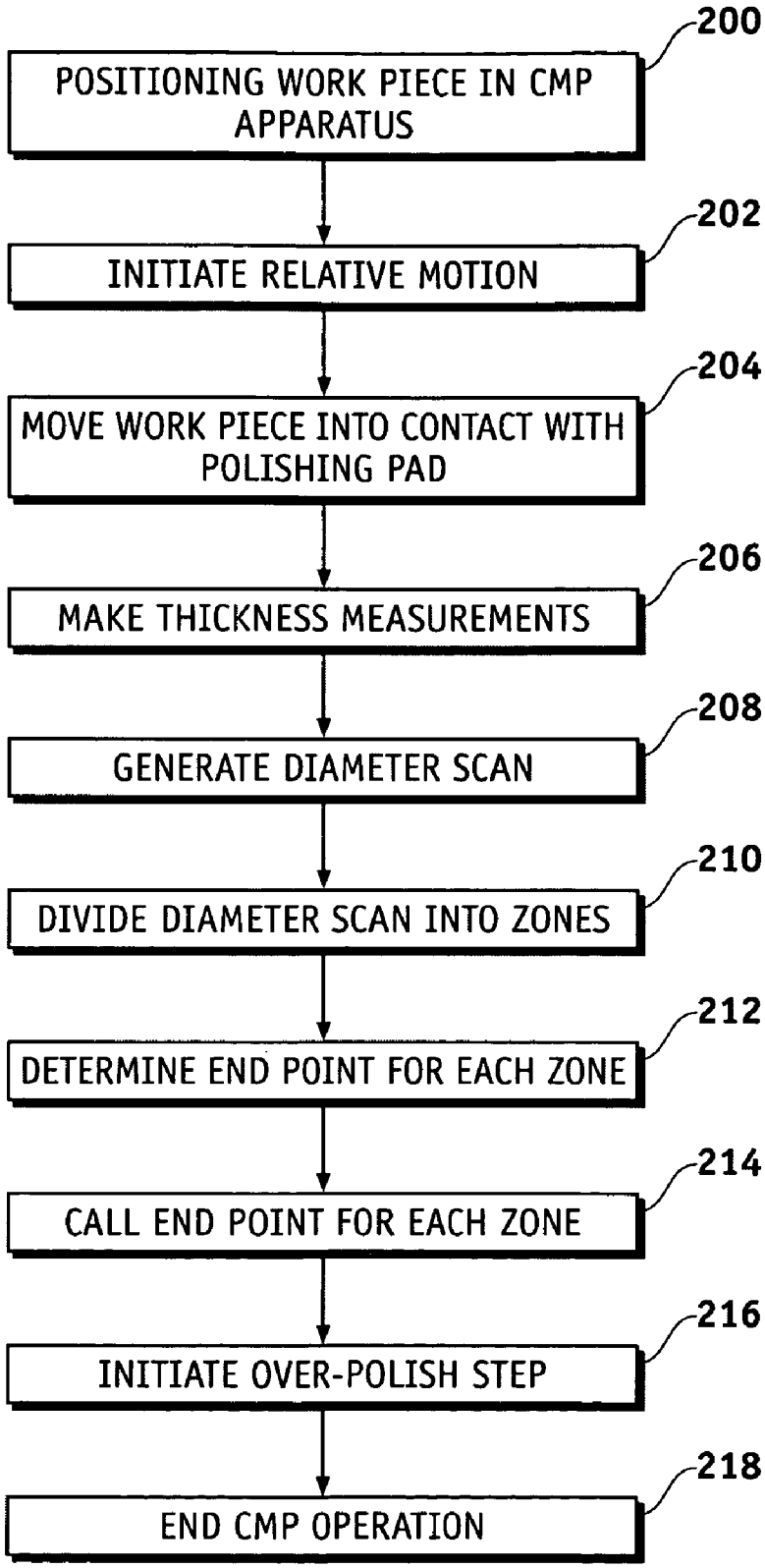
FIG. 3 illustrates in flow chart format a method in accordance with a further embodiment of the invention.

FIG. 3 illustrates, in flow chart format, a method for the planarization of a layer in accordance with a further embodiment of the invention. The method in accordance with this embodiment of the invention begins at step 200 by positioning a work piece such as a semiconductor wafer in a CMP apparatus such as that illustrated in FIG. 1. The layer to be planarized is a layer, for example a layer of copper metallization, on a surface of the work piece. The CMP apparatus includes a work piece carrier that holds the work piece and a polishing pad. The polishing pad can be supported on a platen and can be wetted by a polishing slurry that is selected based on the composition of the layer to be planarized. The CMP apparatus also includes one or more end point detectors such as eddy current based end point detector systems. Preferably the CMP apparatus includes at least four eddy current detector systems.

At step 202 relative motion is initiated between the work piece and the polishing pad. In accordance with a preferred embodiment of the invention the work piece carrier and the work piece are set in rotational motion about an axis perpendicular to the layer that is to be planarized, and the polishing pad is set into orbital motion. Although various parameters can be used for the relative motion, typical parameters are a rotation of about 11 revolutions per minute (rpm) and an orbital radius of about 1.6 centimeters at an orbit speed of about 600 rpm. At step 204 the work piece is moved into contact with the polishing pad to initiate polishing or planarization of the layer on the work piece.

At step 206 measurement of thickness of the layer on the work piece by the plurality of end point detectors is initiated. The end point detectors make measurements periodically, such as every one millisecond. Measurements made by the plurality of end point detectors are reported to a computer or other end point controller. In accordance with a preferred embodiment of the invention at step 208 a diameter scan is generated based on the measurements reported to the computer. The diameter scan can be generated and updated at some predetermined interval of time such as once every second. At step 210 each of the diameter scans is divided into one or more zones representative of zones, preferably concentric annular zones, on the work piece.

At step 212 the end point is determined for each of the zones in the same manner as explained above with respect to the flow chart of FIG. 2. When the end point has been called at each of the zones as indicated at step 214 a short over-polish is initiated at step 216. The over-polish step can be, for example, a continuation of the CMP operation for a predetermined length of time such as for ten seconds. The over-polish step insures that all of the layer that was intended to be removed has, in fact, been removed. Following the over-polish step the CMP operation is terminated at step 218. The CMP operation is terminated by moving the work piece out of contact with the polishing pad and by ceasing the relative motion between the work piece and the polishing pad.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing the exemplary embodiment or exemplary embodiments. It should be understood that various changes can be made in the function and arrangement of elements without departing from the scope of the invention as set forth in the appended claims and the legal equivalents thereof. Although some of the various exemplary embodiments of the invention have made specific reference to semiconductor wafers as an example of work pieces and to copper or other metal layers on the semiconductor wafers, the invention is not limited to application to these specific work pieces. Additionally, although in preferred embodiments of the invention the end point detector of choice is an eddy current based end point detector, the invention is also applicable to thickness measurements made by other types of end point detectors.

What is claimed is:

1. A method for determining the endpoint of a CMP operation on a layer overlying a work piece, the method comprising the steps of:

making a plurality of eddy current measurements of thickness of the layer during a CMP operation, each of the plurality of eddy current measurements spaced apart in time by a predetermined length of time;

generating a diameter scan based upon the plurality of eddy current measurements;

dividing the diameter scan into a plurality of zones, calculating a difference in thickness measured between sequential ones of the plurality of eddy current measurements in each of the plurality of zones;

calculating a moving average of the differences in thickness for each of the plurality of zones;

setting a minimum threshold for the moving average; and determining the endpoint of the CMP operation when the moving average is equal to or less than the minimum threshold in each of the plurality of zones;

wherein the steps of making, generating, dividing, and calculating a difference in thickness are performed in a continuous loop until the endpoint of the CMP operation is determined.

2. A method for determining the endpoint of a CMP operation on a work piece, the method comprising the steps of:

making a plurality of eddy current based measurements of thickness of a layer being removed from the work piece during the CMP operation at a plurality of locations on the work piece and at a plurality of times;

assigning the plurality of eddy current based measurements of thickness to zones of the work piece;

calculating an average thickness of the layer for each of the zones based on the plurality of eddy current based measurements of thickness assigned to that zone for each of the plurality of times;

calculating an incremental removal rate for each zone in response to calculating an average thickness in sequential ones of the plurality of times;

comparing the incremental removal rate to a threshold removal rate; and determining an endpoint of the CMP operation if the incremental removal rate for all zones is less than or equal to the threshold removal rates wherein the steps of making assigning and calculating an average are performed continuously in a loop until the endpoint of the CMP operation is determined.

3. The method of claim 2 wherein the step of assigning comprises the step of assigning the plurality of eddy current based measurements of thickness to concentric zones.

4. The method of claim 3 further comprising the step of generating a diameter scan in response to the step of making a plurality of eddy current based measurements of thickness, the diameter scan intersecting the concentric zones.

5. The method of claim 2 further comprising the step of calculating a moving average of the incremental removal rates and wherein the step of comparing comprises the step of comparing the moving average of incremental removal rates to the threshold removal rate.

6. A method for determining the endpoint of a CMP operation to remove a layer from a work piece, the method comprising the steps of:

making a plurality of eddy current based measurements to obtain thickness values of the layer during the CMP operation at a plurality of locations on the work piece and at a plurality of incremental times;

dividing the thickness values obtained at the plurality of locations in each increment of the plurality of incremental times into a plurality of thickness values of the layer in a plurality of zones on the work piece for each increment of time;

calculating an average thickness value for each of the zones for each increment of time;

determining an incremental removal rate for each of the zones in response to calculating average thickness values for each of the zones in sequential ones of the increments of time;

calculating a moving average of the incremental removal rate for each of the zones;

setting a predetermined removal rate threshold value;

comparing the moving average of the incremental removal rate for each of the zones to the predetermined removal rate threshold value; and calling an endpoint for the CMP operation if the incremental removal rate for each zone is less than the removal rate threshold value;

wherein the steps of making dividing and calculating an average thickness value are performed continuously in a loop until the endpoint of the CMP operation is determined.

7. A method for chemical mechanical planarization of a layer overlying a work piece comprising the steps of:

positioning the work piece in a CMP apparatus, the CMP apparatus comprising a work piece carrier and a polishing pad;

initiating relative motion between the work piece and the polishing pad;

moving the work piece into contact with the polishing pad;

continuously measuring the thickness of the layer at a plurality of locations in a plurality of zones on the work piece and at a plurality of time increments during the chemical mechanical planarization;

calculating a difference in thickness of the layer in each of the plurality of zones in sequential time increments;

calculating a moving average of the difference in thickness in each of the plurality of zones;

setting a predetermined minimum incremental difference in thickness threshold;

comparing the difference the moving average of the difference in thickness to the predetermined minimum incremental difference in thickness threshold for each of the plurality of zones; and maintaining the relative motion for a predetermined length of time in response to the difference in thickness of the layer being less than the predetermined incremental difference in thickness threshold in each of the plurality of zones.

8. The method of claim 7 wherein the step of initiating relative motion between the work piece and the polishing pad comprises the step of initiating orbital motion of the polishing pad and rotation of the work piece about an axis perpendicular to the layer.

9. The method of claim 7 wherein the step of measuring thickness of the layer comprises measuring thickness based on an eddy current measurement.

10. The method of claim 9 wherein the step of measuring thickness based on an eddy current measurement comprises the step of measuring thickness by four eddy current probes positioned beneath the polishing pad.

* * * * *

UNITED STATES PATENT AND TRADEMARK OFFICE

CERTIFICATE OF CORRECTION

PATENT NO. : 7,622,052 B1
APPLICATION NO. : 11/473944
DATED : November 24, 2009
INVENTOR(S) : Quarantello et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 659 days.

Signed and Sealed this

Twenty-sixth Day of October, 2010

David J. Kappos

David J. Kappos
*Director of the United States Patent and Trademark Office*